US005873135A

United States Patent [19]

Törnqvist

[11] Patent Number: 5,873,135

[45] Date of Patent: Feb. 23, 1999

[54] AIR PRESSURE DRIVEN VACUUM SEWER SYSTEM

[75] Inventor: Hans Törnqvist, Bromölla, Sweden

[73] Assignee: EVAC AB, Promolla, Sweden

[21] Appl. No.: 28,286

[22] Filed: Feb. 24, 1998

Related U.S. Application Data

[63] Continuation of Ser. No. 674,580, Jul. 5, 1996, Pat. No. 5,813,061, which is a continuation of Ser. No. 359,276, Dec. 16, 1994, abandoned.

[51] Int. Cl.[6] ..... E03D 11/10

[52] U.S. Cl. ..... 4/431

[58] Field of Search ..... 4/321, 431, 434

[56] References Cited

U.S. PATENT DOCUMENTS

| | | |
|---|---|---|
| 842,100 | 1/1907 | Von Lindenstamm . |
| 1,619,369 | 3/1927 | Riegel . |
| 1,778,520 | 10/1930 | Curtiss . |
| 1,889,480 | 11/1932 | Kelley . |
| 2,397,870 | 4/1946 | Kneass, Jr. . |
| 2,595,737 | 5/1952 | Von Rotz . |
| 2,651,995 | 9/1953 | Blackburn . |
| 2,723,678 | 11/1955 | Wilson . |
| 2,998,198 | 8/1961 | Young . |
| 3,482,267 | 12/1969 | Liljendahl . |
| 3,629,099 | 12/1971 | Gahmberg et al. . |
| 3,863,428 | 2/1975 | Baxter . |
| 4,009,912 | 3/1977 | Mraz . |
| 4,034,421 | 7/1977 | Pihl et al. . |
| 4,184,506 | 1/1980 | Varis et al. . |
| 4,734,943 | 4/1988 | Mellinger et al. . |
| 4,791,688 | 12/1988 | Krishnakumar et al. . |
| 5,133,853 | 7/1992 | Mattsson et al. . |
| 5,396,668 | 3/1995 | Haatanen . |
| 5,535,770 | 7/1996 | Nurmi . |

*Primary Examiner*—Robert M. Fetsuga
*Attorney, Agent, or Firm*—Smith-Hill and Bedell

[57] ABSTRACT

A vacuum sewer system comprises a normally closed sewer valve connected between the outlet opening of a waste receiving unit to be emptied and a sewer pipe, and an ejector. The ejector is an integrated part of the sewer pipe. The sewer pipe includes one portion forming a suction pipe of the ejector and another portion forming a discharge pipe of the ejector.

19 Claims, 5 Drawing Sheets

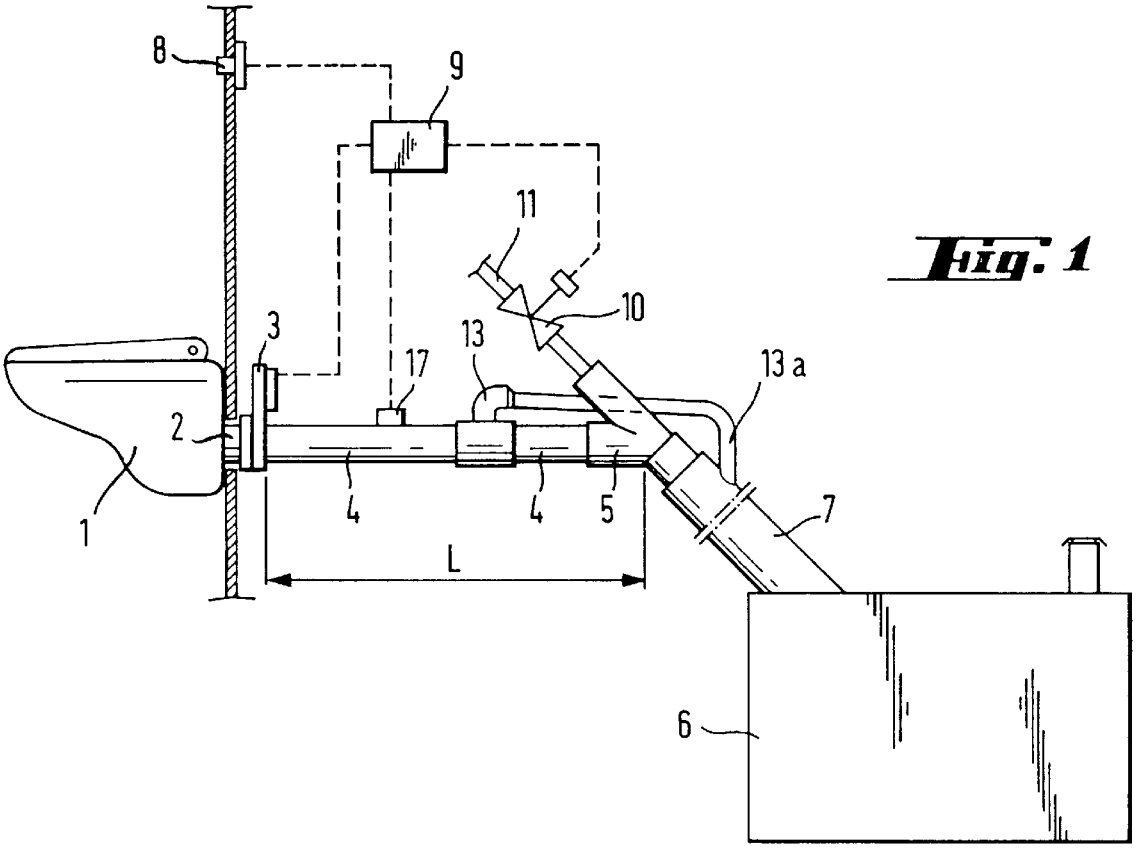
Fig. 1
Fig. 2
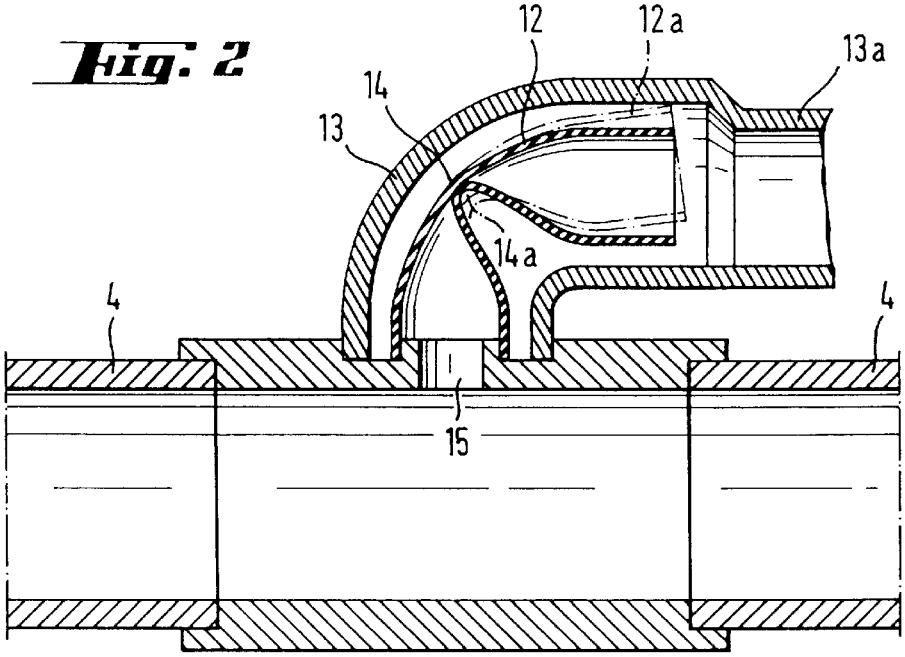

AIR PRESSURE DRIVEN VACUUM SEWER SYSTEM

CROSS-REFERENCE TO RELATED APPLICATION

This is filed as a continuation of application Ser. No. 08/674,580 filed Jul. 5, 1996, now U.S. Pat. No. 5,813,061, which was filed as a continuation of application Ser. No. 08/359,276 filed Dec. 16, 1994, abandoned.

BACKGROUND OF THE INVENTION

This invention relates to an air pressure driven vacuum sewer system.

In a vacuum sewer system, the sewer pipe must be kept under partial vacuum to enable the waste transport, typical of a vacuum sewer system, to be accomplished. On the other hand, it is convenient to keep the sewage collecting container at atmospheric pressure, because this allows the container to be made to less demanding standards than if it were kept under partial vacuum and also facilitates the emptying of the container. The known solutions for achieving these two conditions are, however, relatively complicated and expensive. See, for instance, U.S. Pat. Nos. 3,629,099, 4,184,506, and 4,034,421.

It is known to use a liquid-driven ejector for generating vacuum in a vacuum sewer system. For example, U.S. Pat. No. 4,034,421 shows a system with a liquid driven ejector at the downstream end of the sewer, which ejector generates the partial vacuum necessary for sewage transport. However, this known arrangement is expensive because a separate circulation pump must be used to drive the ejector. Besides, the efficiency rate of the vacuum generation is low, typically only about 5 percent.

In the system shown in U.S. Pat. No. 4,034,421, the working medium supplied to the ejector is untreated sewage, which sets special demands, e.g. with regard to cleaning etc., on the circulation pump and on the ejector. Furthermore, although this sewage might have been ground, it is nevertheless inhomogeneous and therefore requires a large nozzle in the ejector and a high pumping rate and pressure. It would in principle be possible to use another liquid as working medium, but this has significant drawbacks, particularly when applied to a vacuum sewer system for a land-based passenger transport vehicle, such as a bus or a railroad train. In particular, use of another liquid as working medium would necessitate that a supply of liquid be carried aboard the vehicle. Further, it would be necessary either for the sewage collecting container to be sufficiently large to contain the liquid working medium as well as the sewage received from the waste receiving unit(s) or to provide a device for filtering liquid from the sewage downstream of the ejector, neither of which measures is attractive.

U.S. Pat. No. 4,791,688 shows a system that is similar to that shown in U.S. Pat. No. 4,034,421 but in which, in addition, there is employed an extra external air supply for ensuring sewage transport.

SUMMARY OF THE INVENTION

The object of the invention is to simplify the equipment required in a vacuum sewer system in which the sewage collecting container is kept at atmospheric pressure.

The invention is based on the principle that the required partial vacuum in the sewer pipe is generated by means of an air pressure driven ejector arranged as an integrated part of the sewer pipe itself. The ejector is preferably located relatively close to a waste receiving unit that is to be emptied into the vacuum sewer to facilitate servicing or repair of the ejector. A typical such unit is a toilet bowl, the outlet of which is connected to the vacuum sewer via a normally closed sewer valve. The invention makes it possible to considerably reduce the amount of energy that is required on each occasion that a toilet bowl or the like is emptied. At the same time, the number of parts required in the system is reduced to a minimum.

The invention is considerably simpler than known systems. Because air can be used as the working medium of the ejector, the invention is particularly suitable for use in a land-based passenger transport vehicle, such as a railroad train or a bus. Such vehicles usually have a compressed air system comprising a compressor, a compressed air tank, and a pipe system for distributing compressed air from the compressed air tank to various operating devices in the vehicle, such as brakes and door opening and closing mechanisms, and the existing compressed air system can be used as a driving system for a vacuum sewer system according to the invention. The capacity of the existing compressed air system is usually sufficient for the limited use required by a vacuum sewer system according to the invention and so it is not necessary to incur the cost of providing an additional compressed air system in order to employ the invention. However, if the capacity of the existing compressed air system should be too small, it can easily be increased by adding a further compressed air tank or replacing the existing tank with a larger one. The compressor normally operates intermittently, and only during short intervals, and its capacity is sufficient to maintain a enlarged storage volume under pressure.

If, for some reason, it is more convenient to use some other gas than air as the working medium in the ejector, this can be done within the general scope of the invention.

In use of the invention, there is a risk that a temporary stoppage or slowing down will occur in the sewage transport downstream of the ejector. In this case, the operation of the ejector will rapidly increase the pressure in the sewer pipe and this pressure increase may propagate upstream of the ejector to any toilet bowl that is connected during flushing to the sewer and create an undesired pressure surge in the wrong direction (blowback) in the toilet. Security devices eliminating this risk may be arranged between the toilet bowl and the ejector. If the pressure in the sewer pipe between the ejector and the toilet bowl when the sewer valve is open rises higher than the pressure in the toilet bowl, the security devices will rapidly close down the ejector or by some other means reduce or eliminate the pressure rise. The security devices may comprise a pressure-sensitive relief valve as well as a pressure sensor connected to the driving system of the ejector. In this way the highest security is obtained because a closing down of the ejector as well as reduction of the pressure can be obtained simultaneously.

A simple but reliable and effective relief valve may comprise a flexible hose, which is connected to the sewer pipe and is normally kept in a bent position so that a closing fold is formed in the hose. The hose should have the possibility of taking, under the influence of internal pressure, a straighter position, in which the fold opens and forms a through-flow duct. When partial vacuum prevails in the sewer pipe, the closing fold of the hose works as a non-return valve since the outer atmospheric pressure closes the fold of the hose, so that it forms a totally tight closure. For any outflow via the hose, a tube duct is arranged, which, for instance, is connected to the sewage collecting container of the system.

In a system according to the invention having optimum characteristics, it is sufficient that the ejector is fed with pressurized air for, at the most, a few seconds, At a dynamic pressure in the pressure air network of about 5 bar gauge, less than 5 seconds air delivery is normally required to empty a toilet bowl. Thereby, the pressure in the sewer pipe, between the sewer valve and the ejector, is reduced by about 25 to 45 percent (to about 0.25 to 0.45 bar below atmospheric pressure), which is quite sufficient for obtaining an effective emptying of a toilet bowl. The rate of supply of air to the ejector is normally in the order of magnitude of 1000 liters/minute wherein the volume of air is calculated at standard temperature and pressure (0° C., standard atmosphere). It is of course of advantage to reduce the amount of air fed to the ejector as much as possible without thereby taking any risks with respect to the secure functioning of the system, since the smaller the consumption of air, the smaller is the energy consumption.

The energy consumption of an emptying cycle is also influenced by the volume that is to be placed under partial vacuum. The smaller this volume, the smaller is the energy consumption. The portion of the sewer pipe which is placed under partial vacuum must not, however, be too short, since the vacuum volume will then be too small to obtain effective emptying of a toilet bowl. In the case of a sewer pipe with a bore diameter of about 50 mm, it is recommended that the length of the sewer pipe between the sewer valve and the ejector is from 1 to 5 m, preferably from 2 to 3 m.

The action of the ejector produces a considerable partial vacuum just downstream of the nozzle at which the working medium supply inlet debouches into the ejector. The function of the pressurized air driven ejector may be enhanced by providing the portion of the sewer pipe which forms the discharge pipe of the ejector, within the section where the ejector produces a considerable partial vacuum, with an inner flexible sleeve member forming between its external surface and the sewer pipe a space sealed from the interior of the sewer pipe. This space should be in communication with the atmosphere surrounding the sewer pipe. During operation of the ejector, a sleeve member arranged in this manner will be contracted, by the flow forces and by the pressure of the ambient atmosphere, to a diameter that is considerably smaller than the diameter of the sewer pipe. Such a flexible sleeve member essentially improves the effect of the ejector, and the amount of pressurized air used may then be reduced, in many cases by up to ⅔. The sleeve member may have a length of only about 10 cm in its unloaded mounted position. It is preferably mounted immediately downstream of the section where the suction pipe of the ejector joins the discharge pipe of the ejector. For obtaining the best action of the sleeve member, the upstream portion of the sleeve member includes a number of axially oriented stiffening portions which provide a guiding effect on the contracting motion of the sleeve member, especially in its starting phase. The contraction of a suitably devised rubber sleeve member with a wall thickness of about 1 mm and a length of 110 mm, which as described is mounted in a sewer pipe with a bore diameter of about 55 mm, may result in the free opening in the center of the sleeve member having a diameter of only about 10 mm.

The ejector may be devised in a number of different ways. One arrangement, usual in ejectors, is for the suction pipe to join the discharge pipe at an angle. It is then suitable that the portion of the sewer pipe at the upstream side of the ejector and the portion of the sewer pipe at the downstream side of the ejector together form an angle of at least 120°, preferably at least 135°. At smaller angles there is a greater risk for disturbances in the flow of sewage through the sewer pipe. It is also feasible for the sewer pipe to run mainly or substantially linearly through the ejector and for the working medium of the ejector to be supplied either through nozzles arranged circumferentially in the sewer pipe, or through a nozzle that extends from the exterior of the sewer pipe through the pipe wall into the interior of the sewer pipe. In this last-mentioned case, it is important for the nozzle member to be provided with such diverting surfaces that the risk of sewage matter getting caught by the nozzle member or by its attachment members is practically eliminated.

BRIEF DESCRIPTION OF THE DRAWINGS

Embodiments of the invention will now be described, by way of example only, with particular reference to the accompanying drawings, in which:

FIG. 1 schematically shows a vacuum sewer arrangement according to the invention;

FIG. 2 schematically shows a sectional view of a relief valve for an arrangement according to the invention;

DETAILED DESCRIPTION

Figure 9:
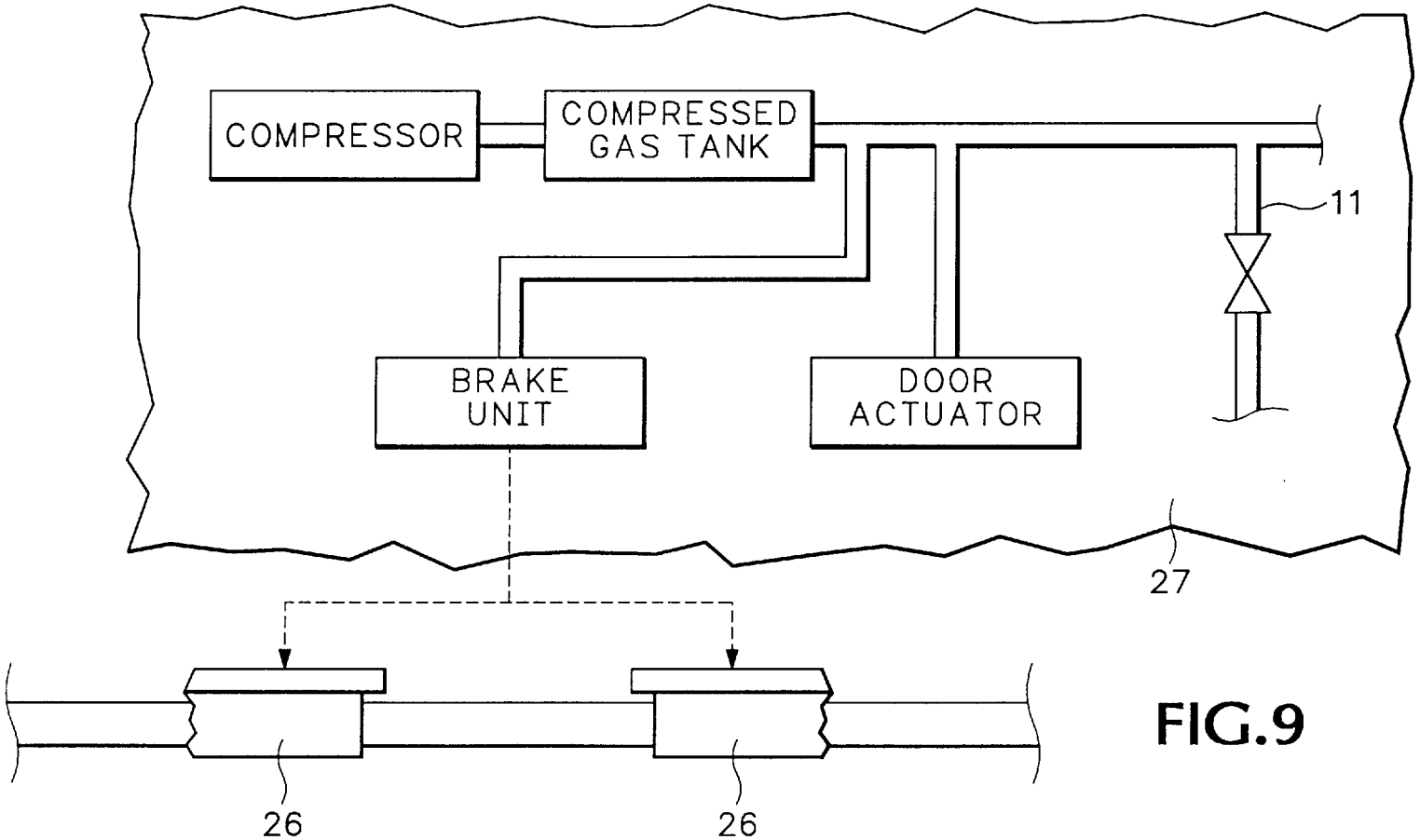
FIG. 9 is a schematic diagram illustrating components of a railroad passenger car.

The railroad car shown in FIG. 9 has a compressed gas system that includes a compressor, a compressed gas tank, and a pipe system for distributing compressed gas from the compressed gas tank to various operating devices in the railroad car, such as brakes and door opening and closing mechanisms. A vacuum sewer system, which is described in detail with reference to FIGS. 1–7, is installed in the railroad car. The pipe system of the railroad car shown in FIG. 9 includes a pipe 11 (FIG. 1) for supplying compressed gas to an ejector that is part of the vacuum sewer system.

In FIG. 1 of the drawings, reference numeral 1 indicates a toilet bowl having an outlet 2 normally closed by a sewer valve in the form of a disc valve 3 which may be of the type described in U.S. Pat. No. 4,713,847. The upstream end of a vacuum sewer comprises a sewer pipe 4 which is directly connected to the disc valve 3. To empty the toilet bowl 1, a partial vacuum is generated in the vacuum sewer by a pressurized air ejector 5, which forms an integrated part of the sewer pipe. Downstream of the ejector 5, a sewer pipe 7 leads to a sewage collecting container 6. The sewer pipe 7 situated between the ejector 5 and the collecting container 6 does not form a vacuum sewer, because it is at the pressure side of the ejector 5. Also the collecting container 6 is outside the vacuum system and is consequently under atmospheric pressure. The length of the sewer pipe 7 is a considerable part of the overall length of the sewer pipe from the disc valve 3 to the container 6, and may be several meters.

In order to empty the toilet bowl 1, a user operates a push button 8, or some other suitable device, transmitting an electric signal to a control center 9, which controls all the functions of the vacuum sewer arrangement. On operation of the push button 8, the control center 9 opens a remote-controlled gas feed valve 10 connected to the ejector 5, whereby pressurized gas from a pipe 11 of a compressed gas system rushes into the ejector. The compressed gas, which may be air or a gas or gas mixture other than air, operates as a working medium of the ejector and generates in a very short time a considerable partial vacuum in the ejector and in the sewer pipe 4. Then the disc valve 3 is rapidly opened, and the ambient atmospheric pressure present in the interior space of the toilet bowl instantaneously causes the contents of the toilet bowl 1 to be pushed into the sewer pipe 4. The ejector 5 is then still in operation and maintains partial vacuum downstream of a plug of sewage that moves very rapidly from the toilet bowl 1 through the pipe 4. Simultaneously, the ejector 5 blows the pipe 7 clean of any liquid or impurity that might be present there. In the embodiment shown, the distance L between the disc valve 3 and the ejector 5 is about 2.3 m. The downstream portion 7 of the sewer pipe is typically of considerable length (i.e. several meters) so that the ejector is positioned between the ends of, and not at one or the other end of, the combined sewer pipe extending from the disc valve 3 to the collecting container 6 and formed of the sewer pipe portions 4 and 7. The pneumatic pressure created by the ejector in the pipe 7 assists in transportation of sewage through the pipe 7. The system works well even if the ejector is positioned relatively close to the collecting container, but for service and/or repair of the ejector it is preferred that the ejector be positioned relatively close to the toilet bowl 1.

To protect the system from undesirable pressure surges, the vacuum sewer pipe 4 is provided with a relief valve 13 and with a pressure sensor 17 connected to the control center 9. On detecting a rise of pressure in the pipe 4, the pressure sensor 17 rapidly closes the valve 10 thereby stopping further air delivery to the ejector 5.

When the ejector 5 is in operation and the valve 3 is opened, the toilet bowl 1 is also supplied with a desired amount of rinse liquid in a manner that cleans the inner surface of the toilet bowl. This function is not described in detail, because it is well known in the art and does not itself have any influence on the application of the invention.

As explained in more detail with reference to FIG. 8, the ejector is normally closed about 0.5 seconds after the opening of the valve 3. In this time the sewage reaches and passes the ejector 5. Because the sewage is driven forwards by the ambient atmospheric pressure, it is important that the valve 3 is kept open a sufficient length of time, usually about 3 seconds, that a sufficiently large amount of air flows, via the outlet 2 of the toilet bowl, into the sewer pipe 4. When the valve 3, upon emptying of the toilet bowl 1, is again closed, the control center 9 keeps it closed for about at least 5 seconds to ensure that all the sewage reaches the collecting container 6 before the next flush is carried out.

In FIG. 2, a simple relief valve in the form of a flexible hose 12 is schematically shown. The hose 12 is surrounded by a protective tube 13 and is bent about 90° so that a fold or kink 14 is formed in the hose. The hose remains bent because of the weight of the part of the hose to the right of the fold 14. The interior of the hose 12 is connected via an aperture 15 to the interior of the vacuum sewer pipe 4. The fold 14 totally closes the hose 12, especially when the pressure outside the hose is higher than in the interior of the vacuum sewer pipe 4. If overpressure occurs in the sewer pipe 4, the hose 12 is under the influence of this pressure and is then somewhat straightened to adopt the position 12*a* shown in dashed lines in FIG. 2. In this position 12*a*, an aperture 14*a* is opened up at the point where the hose is normally closed by the fold 14. The overpressure can then discharge through the aperture 14*a*. The protective tube 13 has a continuation 13*a* shown only partly in FIG. 2. This continuation 13*a* connects the relief valve in a suitable manner to the sewer pipe 7 downstream of the ejector, as schematically shown in FIG. 1, or directly to the collecting container 6, in both cases in a manner that allows gravity induced flow.

Figure 3:
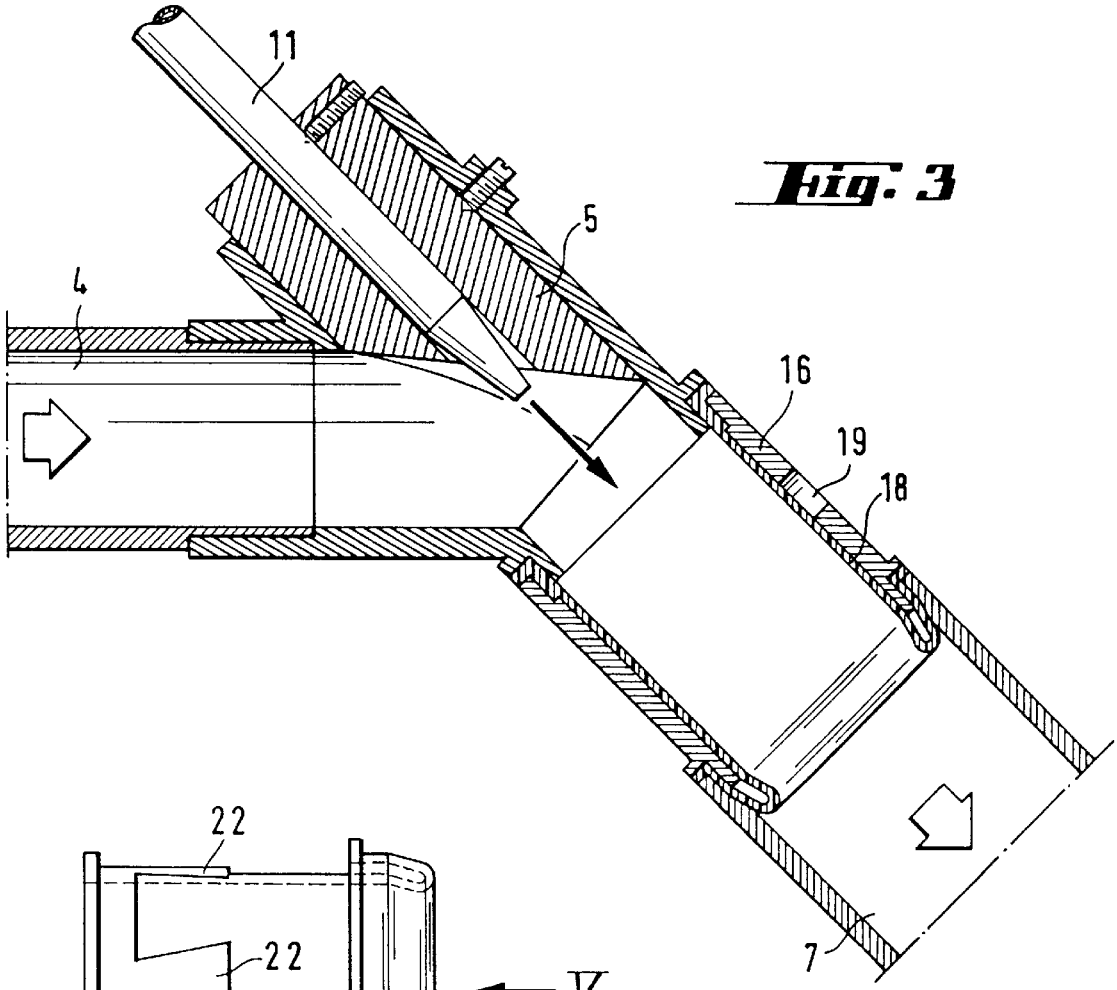
FIG. 3 schematically shows an axial section of an ejector according to the invention.

FIG. 3 schematically shows a preferred embodiment of an ejector according to the invention. The vacuum sewer pipe 4 forms an angle of 135° relative to the sewer pipe 7 downstream of the ejector 5. In the embodiment shown the vacuum sewer pipe 4 is mainly horizontal and the sewer pipe 7 is inclined downwards in the flow direction. It is also feasible for the pipes 4 and 7 to be substantially parallel, but at different levels and/or in different vertical planes, whereby the sewer pipe 4 just upstream of the ejector 5 is bent about 45° for its connection to the ejector. However, the embodiment shown in FIG. 3 has proved to be the best with respect to operational reliability.

Figure 4:
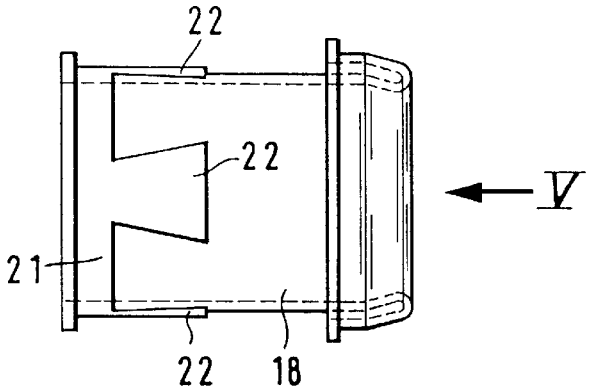
FIG. 4 shows a side view of a rubber sleeve member that is part of the ejector shown in FIG. 3.
Figure 5:
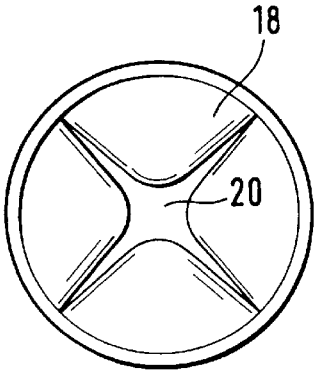
FIG. 5 schematically shows an end view of the rubber sleeve member according to FIG. 4, in a contracted position.

The working medium of the ejector 5 is a compressed gas, preferably compressed air, and is introduced into the ejector through the pipe 11 at a dynamic pressure of about 5 bar gauge. It is introduced through an aperture of about 3 mm in diameter at the end of the pipe 11 into the ejector 5 and flows mainly in the longitudinal direction of the sewer pipe 7. Immediately downstream of the pipe 11, the ejector function generates a considerable vacuum within a zone of a length of some tens of centimeters. About in the middle, in the longitudinal direction, of this zone there is a flexible rubber sleeve 18. Between the external surface of the sleeve 18 and the surrounding pipe wall 16, a pressure chamber is formed which is in communication, via an aperture 19, with the atmosphere. Because the sleeve 18 is bent over or double-bent at its downstream end, as shown in FIGS. 3 and 4, it has a relatively large freedom of motion. The vacuum generated by the ejector 5 in cooperation with the atmospheric pressure, which through the aperture 19 influences the sleeve 18, causes the sleeve to contract by forming folds as schematically shown in FIG. 5 and thereby provides a pressure induced reduction in the cross-sectional area of the discharge pipe of the ejector. The free opening 20 in the center of the contracted sleeve has a diameter of only about 10 mm. The contracting function of the sleeve has a very advantageous influence on the effectiveness of the ejector 5 and strongly contributes to reducing the air consumption of the ejector. When sewage passes through the sleeve 18, the folded sleeve expands so that larger solid ingredients are also able to pass without difficulty through the sleeve.

As is apparent from FIG. 4, the sleeve 18 includes, at its inlet end, a stiffener comprising a cylindrical portion 21 from which four circumferentially spaced-apart, axial portions 22 extend to almost the longitudinal middle portion of the sleeve in its double-bent position. The stiffener is an integral part of the sleeve 18 and is formed by locally increasing the thickness of the sleeve. The wall thickness of the sleeve 18 is about 1 mm, except that the stiffener portions 21, 22 have a wall thickness of about 2 mm. Thus, the stiffener projects about 1 mm beyond the general outer surface of the sleeve. The axial portions 22 of the stiffener guide contraction of the sleeve 18, so that regular folds according to FIG. 5 are obtained. FIG. 5 shows the sleeve 18 seen from its downstream end. In the embodiment according to FIG. 3, the pipe 7, downstream of the ejector 5, is about 40 percent larger in diameter than the vacuum sewer pipe 4 upstream of the ejector. This reduces the risk of flow stoppage or too slow flow in the pipe 7.

Figure 6:
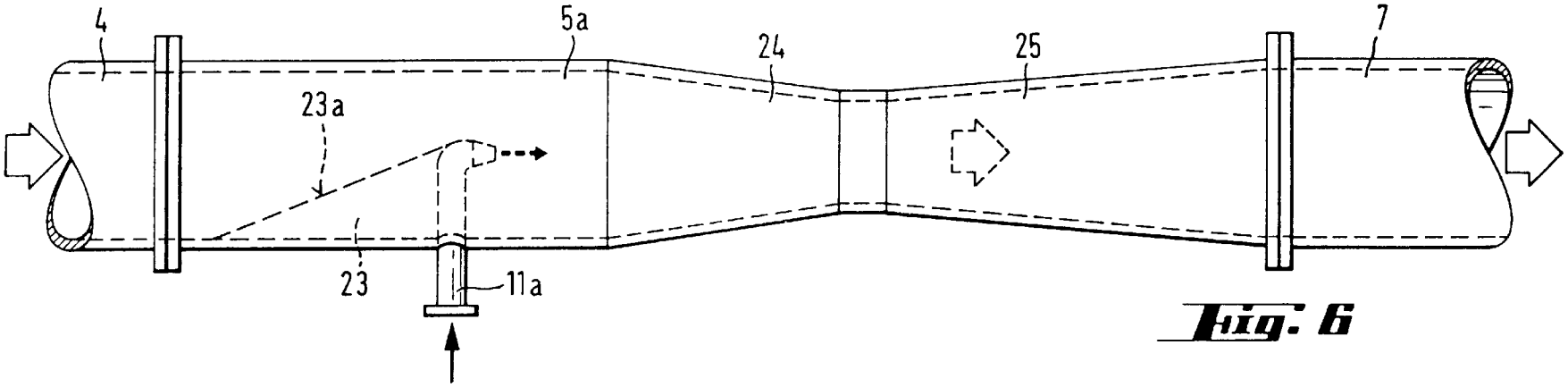
FIGS. 6 and 7 schematically show ejectors of other embodiments than the ejector shown in FIGS. 1 and 3.

FIG. 6 shows an ejector 5*a* which is intended for an embodiment where the vacuum sewer pipe 4 and the sewer pipe 7 downstream of the ejector are in linear configuration relative to each other. The working medium of the ejector is provided through a pipe 11*a* which, from the outside, extends mainly at right angles through the wall of the ejector housing 5*a* up to the center thereof. To prevent solids, in particular fibrous ingredients, in the sewage from being caught by the pipe 11*a*, the pipe 11*a* is provided, at its upstream side, with a deflector plate or the like 23, the upper edge 23*a* of which is inclined at an angle of preferably at the most 30° from the internal surface of the ejector housing to the top of the pipe 11*a*. Immediately downstream of the feed pipe 11*a*, the ejector 5*a* has a tapered contracting flow duct portion 24 followed by an expanding portion 25, which are formed in the manner that is conventional in ejectors. In the ejector shown in FIG. 3, tapered pipe portions such as 24 and 25 are not needed, because the sleeve 18 provides substantially the same function.

Figure 7:
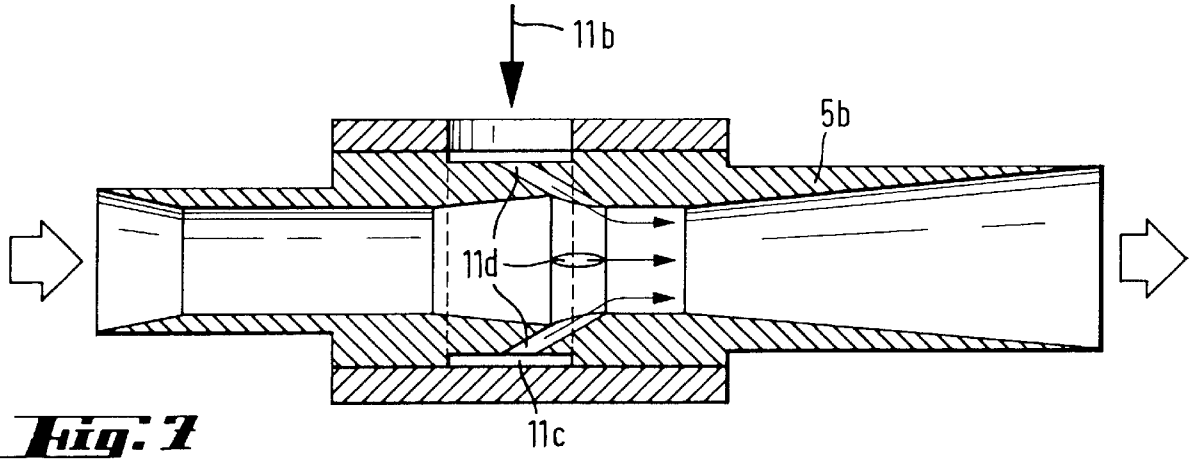

FIG. 7 shows another ejector 5*b* also intended for linear sewer pipe mounting. In this embodiment, air is supplied through a supply pipe 11*b*, shown schematically in FIG. 7, to an annular duct 11*c*, from which the air, via a number of circumferentially arranged feed ducts 11*d*, is blown almost axially into the through flow pipe of the ejector 5*b*.

Figure 8:
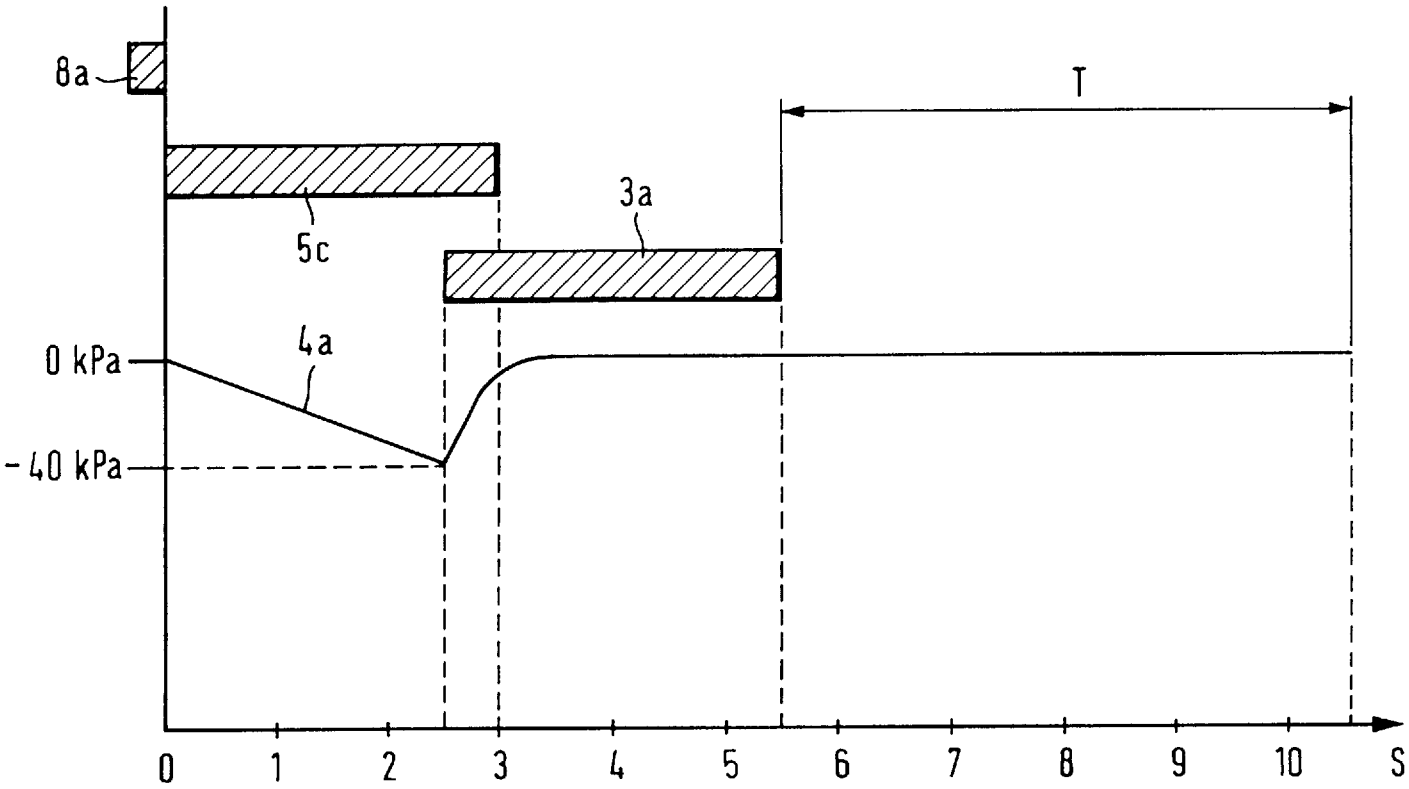
FIG. 8 shows an example of a time chart for the different functions of a vacuum sewer system according to the invention.

FIG. 8 schematically shows operational sequences when a toilet bowl 1 in a system according to FIG. 1 is emptied. The emptying cycle is started by operating the push button 8 for a short period of time, as indicated by section 8*a*. The ejector 5 is activated and operates for about 3 seconds, as indicated by section 5*c*. About half a second before the end of the function phase of the ejector 5, the disc valve 3 is opened and is kept open for about three seconds as indicated by section 3*a*. The function of the ejector reduces the pressure in the vacuum sewer pipe 4 by about 40 kPa, as shown by the curve 4*a*. When the disc valve 3 opens, the pressure in the pipe 4 increases rapidly and, after about one or a few seconds, reaches its original value. After the disc valve 3 has been closed, the system is locked for a time T of about five seconds, to avoid very closely repeated flushes which could cause operational disturbances in the system.

More than one toilet bowl, or other waste receiving unit, may be included in a vacuum sewer system according to the invention. Thus the upstream portion of the sewer pipe may be branched and multiple branches connected to respective toilet bowls, although the number of toilet bowls should not be too great or the consumption of compressed air will be excessive. Typically, therefore, a pair of toilet bowls will be connected to an ejector via an upstream portion having two branches. Preferably, the control center 9 prevents the two toilet bowls from being emptied at the same time.

In all the described embodiments, the ejector is positioned between the ends of the sewer pipe connecting the sewer valve or valves to the collecing container 6. Typically, the distance between the or each sewer valve and the ejector is at least 1 m.

The invention is not limited to the embodiments disclosed, but several variations or modifications thereof are feasible, including variations which have features equivalent to, but not necessarily literally within the meaning of, features in any of the appended claims.

I claim:

1. An improved vacuum sewer system of the kind comprising at least one waste receiving unit to be emptied, said unit having an outlet opening, a sewer pipe having an upstream end and a downstream end, a normally closed sewer valve at the outlet opening of the waste receiving unit and connected between the outlet opening of the waste receiving unit and the upstream end of the sewer pipe, a sewage collecting container connected to the sewer pipe at the downstream end thereof for collecting sewage from the sewer pipe, an ejector having a suction pipe in communication with the sewer pipe, a discharge pipe, and a working medium supply inlet, whereby a considerable partial vacuum is created in the suction pipe when the sewer valve is in closed position and a pressurized working medium is supplied to the ejector by way of the working medium supply inlet so that sewage in the waste receiving unit is forced into the sewer pipe when the sewer valve is opened, wherein the improvement resides in that the ejector is a gas-driven ejector and is integrated into the sewer pipe so that the suction pipe and the discharge pipe of the ejector form respective parts of the sewer pipe, thereby dividing the sewer pipe into an upstream portion, in which sewage is transported due to pressure difference between the ambient atmosphere and partial vacuum created by the ejector, and a downstream portion, in which sewage transport is at least assisted by pneumatic pressure created by the ejector in its discharge pipe.

2. A system according to claim 1, wherein between the waste receiving unit and the ejector there is at least one security device arranged to rapidly close down the ejector if the pressure between the ejector and the waste receiving unit exceeds the pressure in the waste receiving unit when the sewer valve is open.

3. A system according to claim 1, wherein between the waste receiving unit and the ejector there is at least one security device arranged to rapidly dissipate pressure if the pressure between the ejector and the waste receiving unit exceeds the pressure in the waste receiving unit when the sewer valve is open.

4. A system according to claim 1, comprising a driving system arranged to feed the ejector with compressed air as working medium for a few seconds at a flow rate in the order of magnitude of 1000 l/min measured at standard temperature and pressure.

5. A system according to claim 1, wherein the upstream and downstream portions of the sewer pipe are connected to the ejector at an angle, so that the sewer pipe immediately before and after the ejector forms an angle of at least 120°.

6. A system according to claim 1, wherein the upstream and downstream portions of the sewer pipe are connected to the ejector at an angle, so that the sewer pipe immediately before and after the ejector forms an angle of at least 135°.

7. A system according to claim 1, wherein the upstream and downstream portions of the sewer pipe are connected to the ejector substantially in axial alignment and the ejector includes nozzle means for introducing the working medium of the ejector into the sewer pipe at the circumference thereof.

8. A system according to claim 1, wherein the upstream and downstream portions of the sewer pipe are connected to the ejector substantially in axial alignment and the ejector includes at least one nozzle that extends into the sewer pipe through a wall of the sewer pipe for introducing the working medium of the ejector.

9. A system according to claim 1, wherein the length of the sewer pipe between the sewer valve and the ejector is from 1 to 5 m.

10. A system according to claim 1, wherein the length of the sewer pipe between the sewer valve and the ejector is from 2 to 3 m.

11. A system according to claim 1, wherein the diameter of the sewer pipe between the waste receiving unit and the ejector does not substantially exceed about 50 mm.

12. A method of operating a vacuum sewer system that comprises at least one waste receiving unit to be emptied, said unit having an outlet opening, a sewer pipe having an upstream end and a downstream end, a normally closed sewer valve at the outlet opening of the waste receiving unit and connected between the outlet opening of the waste receiving unit and the upstream end of the sewer pipe, a sewage collecting container connected to the sewer pipe at the downstream end thereof for collecting sewage from the sewer pipe, and an ejector having a suction pipe, a discharge pipe, and a working medium supply inlet, wherein the ejector is integrated into the sewer pipe so that the suction pipe and the discharge pipe of the ejector form respective parts of the sewer pipe, thereby dividing the sewer pipe into an upstream portion and a downstream portion, the sewer valve being closed and said method comprising the steps of:

supplying compressed air as working medium to the ejector by way of the working medium supply inlet, whereby a considerable partial vacuum is created in the upstream portion of the sewer pipe, and opening the sewer valve, whereby sewage in the waste receiving unit is forced into the sewer pipe due to pressure difference between the ambient atmosphere and the partial vacuum created by the ejector in the upstream portion of the sewer pipe, and the sewage is transported through the upstream portion of the sewer pipe due to pressure difference between the ambient atmosphere and partial vacuum created by the ejector, and pneumatic pressure created by the ejector in its discharge pipe at least assists in transportation of sewage in the downstream portion of the sewer pipe.

13. A method according to claim 12, comprising detecting pressure in the sewer pipe between the waste receiving unit and the ejector and rapidly closing down the ejector if the pressure between the ejector and the waste receiving unit exceeds the pressure in the waste receiving unit when the sewer valve is open.

14. A method according to claim 12, comprising detecting pressure in the sewer pipe between the waste receiving unit and the ejector and rapidly dissipating pressure between the ejector and the waste receiving unit if the pressure between the ejector and the waste receiving unit exceeds the pressure in the waste receiving unit when the sewer valve is open.

15. A method according to claim 12, comprising feeding the ejector with compressed air as working medium for a few seconds at a flow rate in the order of magnitude of 1000 l/min measured at standard temperature and pressure.

16. A method according to claim 12, further comprising closing the sewer valve and maintaining the sewer valve in closed condition until the waste receiving unit is to be emptied again.

17. A passenger transport vehicle comprising a vehicle body, a compressed air system for generating compressed air and distributing the compressed air to operating devices of the vehicle, and a vacuum sewer system, wherein the vacuum sewer system comprises at least one waste receiving unit, said unit having an outlet opening, a sewer pipe having an upstream end and a downstream end, a normally closed sewer valve at the outlet opening of the waste receiving unit and connected between the outlet opening of the waste receiving unit and the upstream end of the sewer pipe, a sewage collecting container connected to the sewer pipe at the downstream end thereof for collecting sewage from the sewer pipe, and an air-driven ejector having a suction pipe in communication with the sewer pipe, a discharge pipe, a compressed air supply inlet, and a compressed air valve connected between the compressed air system and the compressed air inlet, whereby a considerable partial vacuum is created in the suction pipe when the sewer valve is in closed position and the compressed air valve is opened, whereby sewage in the waste receiving unit is forced into the sewer pipe when the sewer valve is opened, and wherein the ejector is integrated into the sewer pipe so that the suction pipe and the discharge pipe of the ejector form respective parts of the sewer pipe, thereby dividing the sewer pipe into an upstream portion, in which sewage is transported due to pressure difference between the ambient atmosphere and partial vacuum created by the ejector, and a downstream portion, in which sewage transport is at least assisted by pneumatic pressure created by the ejector in its discharge pipe.

18. A vehicle according to claim 17, wherein the vacuum sewer system comprises a means in the discharge pipe of the ejector for pressure induced reduction of the cross-sectional area of the discharge pipe when the ejector is in operation.

19. A vehicle according to claim 17, wherein the diameter of the sewer pipe between the waste receiving unit and the ejector does not substantially exceed about 50 mm.

* * * * *